US005960852A

United States Patent [19]

Kadono et al.

[11] Patent Number: 5,960,852

[45] Date of Patent: Oct. 5, 1999

[54] METHOD OF FORCE-FITTING SEPARATE MEMBER INTO CASTING AND APPARATUS THEREFOR

[75] Inventors: Hidehiko Kadono; Tadaaki Togashi; Hideaki Sukesada, all of Toyota; Yasuhiro Yamashita, Okazaki, all of Japan

[73] Assignee: Toyota Jidosha Kabushiki Kaisha, Toyota, Japan

[21] Appl. No.: 08/868,153

[22] Filed: Jun. 3, 1997

[30] Foreign Application Priority Data

Jun. 24, 1996 [JP] Japan ..... 8-163323
Dec. 17, 1996 [JP] Japan ..... 8-337216

[51] Int. Cl.[6] ..... B22D 17/00

[52] U.S. Cl. ..... 164/76.1; 164/113; 164/312

[58] Field of Search ..... 164/76.1, 270.1, 164/113, 312

[56] References Cited

U.S. PATENT DOCUMENTS 3,952,395 4/1976 Crossman et al. .

FOREIGN PATENT DOCUMENTS

| | | | |
|---|---|---|---|
| 1 086 862 | 8/1960 | Germany . | |
| 1 577 099 | 3/1970 | Germany . | |
| 55-149763 | 11/1980 | Japan . | |
| 61-1461 | 1/1986 | Japan . | |
| 1-241369 | 9/1989 | Japan | 164/113 |
| 643 070 | 5/1984 | Switzerland . | |

*Primary Examiner*—Kuang Y. Lin
*Attorney, Agent, or Firm*—Oblon, Spivak, McClelland, Maier & Neustadt, P.C.

[57] ABSTRACT

A cavity defined by a casting mold is filled with a molten metal in such a condition that a sliding member movable forward and rearward has been moved into the cavity. The sliding member is drawn out of the cavity when the molten metal solidifies to such a degree as to maintain a certain shape. A separate member to be force-fitted is placed between the distal end of the sliding member and the cavity. The sliding member is then advanced into the cavity so that the separate member is force-fitted into a concave portion formed in the casting before the casting mold enclosing the casting is opened. The separate member is thus force-fitted into the casting while the casting is enclosed in the casting mold.

22 Claims, 10 Drawing Sheets

METHOD OF FORCE-FITTING SEPARATE MEMBER INTO CASTING AND APPARATUS THEREFOR

BACKGROUND OF THE INVENTION

1. Field of the Invention

This invention relates generally to a technique for force-fitting a separate member into a casting, and more particularly to such a technique for force-fitting the separate member into the casting while the casting is enclosed in a casting mold.

For example, when a cylinder block of an internal combustion engine having an internal cooling liquid passage is made by casting, a pipe is force-fitted into a casting so that a hose for supplying a cooling liquid to the cooling liquid passage is connected to the cylinder block through the pipe. Furthermore, there is known a technique in which a passage is formed in a casting, the passage being communicated with the outside of the casting at a hole formed at a surface of the casting, and later the hole is closed by force-fitting a separate member into the hole so that the passage closed at the surface of the casting is completed in the casting. The invention meets the above-described needs.

2. Description of the Prior Art

Generally, when a separate member is force-fitted into a casting, the casting is taken out from a casting mold, the taken out casting is cooled, the cooled casting is transferred to a subsequent stage where a force-fitting portion of the casting into which the separate member is to be force-fitted is machined so as to be suitable for the force-fitting, and finally the separate member is force-fitted into the machined portion of the casting. Furthermore, the force-fitting portion is externally caulked after the force-fitting when the caulking is necessary, so that the separate member is prevented from falling off therefrom.

The above-described prior art technique necessitates the machining and force-fitting steps as well as the casting step. As a result, the manufacture of the products requires an increased time and cost.

A force-fitting interference needs to be rendered sufficiently large in order that the separate member is reliably force-fitted into the casting. The force-fitting interference refers to the difference between the outer diameter of the separate member and the inner diameter of a concave portion of the casting into which the separate member is to be force-fitted. The casting tends to be cracked or deformed when the force-fitting interference is rendered large.

SUMMARY OF THE INVENTION

Therefore, an object of the present invention is to eliminate the step of taking out the casting from the casting mold for the force-fitting of the separate member into the casting, thereby reducing the manufacturing time and cost.

Another object of the invention is to force-fit the separate member into the casting while the casting is enclosed in the casting mold, thereby preventing the casting from being cracked or deformed even when the force-fitting interference is rendered large.

Further another object of the invention is to increase the strength of the fixation of the separate member to the casting.

Still further object of the invention is to perform the force-fitting at a timing when a molten metal for casting is solidified to a suitable state for the force-fitting, thereby reliably securing the separate member without the casting and/or the separate member being subjected to an excessive force.

Still further another object of the invention is to eliminate a separate caulking step executed separately from the force-fitting step when the casting needs to be caulked, thereby reducing the manufacturing time and cost.

To accomplish the objects, the present invention provides an improved method of force-fitting a separate member into a casting and an improved apparatus therefor. A cavity defined by a casting mold is filled with a molten metal in such a condition that a sliding member movable forward and rearward has been moved into the cavity. The sliding member is drawn out from the cavity when the molten metal is solidified to such a degree as to maintain a certain shape. The separate member is force-fitted into a concave portion formed in the casting by means of the sliding member before the casting mold is opened.

According to the present invention, the separate member is force-fitted into the casting while the casting is enclosed in the casting mold. Accordingly, the casting need not be taken out from the casting mold for the force-fitting of the separate member. Furthermore, since the separate member is force-fitted into the casting while the latter is enclosed in the casting mold, the casting can be prevented from being cracked or deformed. This allows the force-fitting interference to be rendered large and accordingly, the strength of the separate member having been secured to the casting can be increased. Furthermore, when the separate member is force-fitted into the casting while the casting is enclosed in the casting mold, the metal of the casting is in a solidified state suitable for force-fitting the separate member into the casting. Consequently, the separate member can be reliably secured to the casting without the casting and/or the separate member being subjected to an excessive force.

This invention will be more fully understood upon reading of the following detailed description of the preferred embodiments with reference to the accompanying drawings and claims.

DETAILED DESCRIPTION OF THE PREFERRED EMBODIMENTS

First Embodiment

A casting machine with a force-fitting mechanism in accordance with a first embodiment of the present invention and a method carried out by the casting machine will be described with reference to FIGS. 1 to 6.

Figure 1:
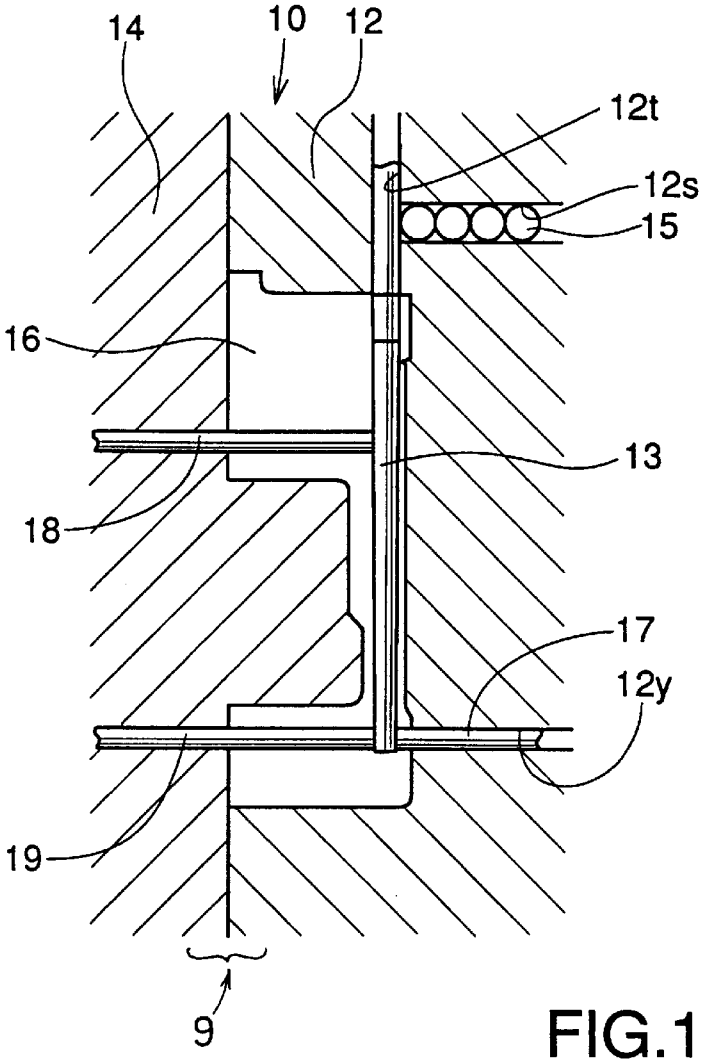
FIG. 1 is a partial longitudinal sectional view of a casting machine with a force-fitting mechanism according to a first embodiment of the present invention.

Referring to FIG. 1, the casting machine with the force-fitting mechanism in accordance with the first embodiment is equipped with a fixed metal mold 12 and a movable metal mold 14 both of which constitute a casting mold 9. The fixed and movable molds 12 and 14 are clamped by a mold clamping mechanism (not shown). In this state, a cavity 16 is defined in the interior of the casting mold 9.

The fixed mold 12 has a pin guide passage 12*t* formed in an upper portion of the fixed mold 12 to extend vertically along an extension line from the cavity 16, as viewed in FIG. 1. A center slide pin 13 for defining a main passage Tm (see FIG. 4) of a casting W is slidably accommodated in the pin guide passage 12*t*. The center slide pin 13 is connected at its upper end to an elevator mechanism (not shown) and has a lower distal end adapted to project a predetermined length out of the pin guide passage 12*t* into the cavity 16.

The fixed mold 12 has a ball passage 12*s* formed in the upper portion thereof to be perpendicular to the pin guide passage 12*t*, as viewed in FIG. 1. A set of balls 15 each serving as a closure member are accommodated in the ball passage 12*s*. The balls 15 are those used in a ball bearing, for example. A coil spring (not shown) is mounted to a right-hand end of the ball passage 12*s* for urging the balls 15 accommodated in the ball passage 12*s* toward the pin guide passage 12*t*. A cylinder, elastic member, magnet, etc. may be used instead of the coil spring. Furthermore, the self-weight of the balls 15 may be utilized for urging them toward the pin guide passage 12*t*. Each of the balls 15 serves as a separate member to be force-fitted into a casting, as will be described later.

The fixed mold 12 has in its lower portion a lateral pin passage 12*y* formed to be parallel to the ball passage 12*s*, as viewed in FIG. 1. A pressure pin 17 is slidably accommodated in the lateral pin passage 12*y*. The pressure pin 17 is driven by a pressure cylinder (not shown) so that its distal end projects a predetermined length into the cavity 16 to thereby support the distal end of the center slide pin 13 positioned in the cavity 16.

First and second draw pins 18 and 19 are mounted on the movable mold 14 for defining first and second passages Th and Ts (see FIG. 4) in the casting W respectively. The first draw pin 18 horizontally projects into the upper interior of the cavity 16, abutting against the side surface of the center slide pin 13, as viewed in FIG. 1. The second draw pin 19 horizontally projects into the lower interior of the cavity 16, abutting against the distal end of the center slide pin 13 at the side opposite to the pressure pin 17.

The operation of the casting machine with the force-fitting mechanism will be described. The elevator mechanism (not shown) is first operated to lower the center slide pin 13 so that the center slide pin projects into the cavity. In this state, the distal end of the pin 13 projects a predetermined length into the cavity 16. The pressure cylinder (not shown) is then operated so that the pressure pin 17 projects into the cavity 16, abutting at its distal end surface against the side surface of the distal end of the center slide pin 13. The mold clamping mechanism (not shown) is then operated to clamp the fixed and movable molds 12 and 14 together, as shown in FIG. 1, such that the distal end surfaces of the first and second draw pins 18 and 19 are abutted against the side surface of the center slide pin 13.

Figure 2:
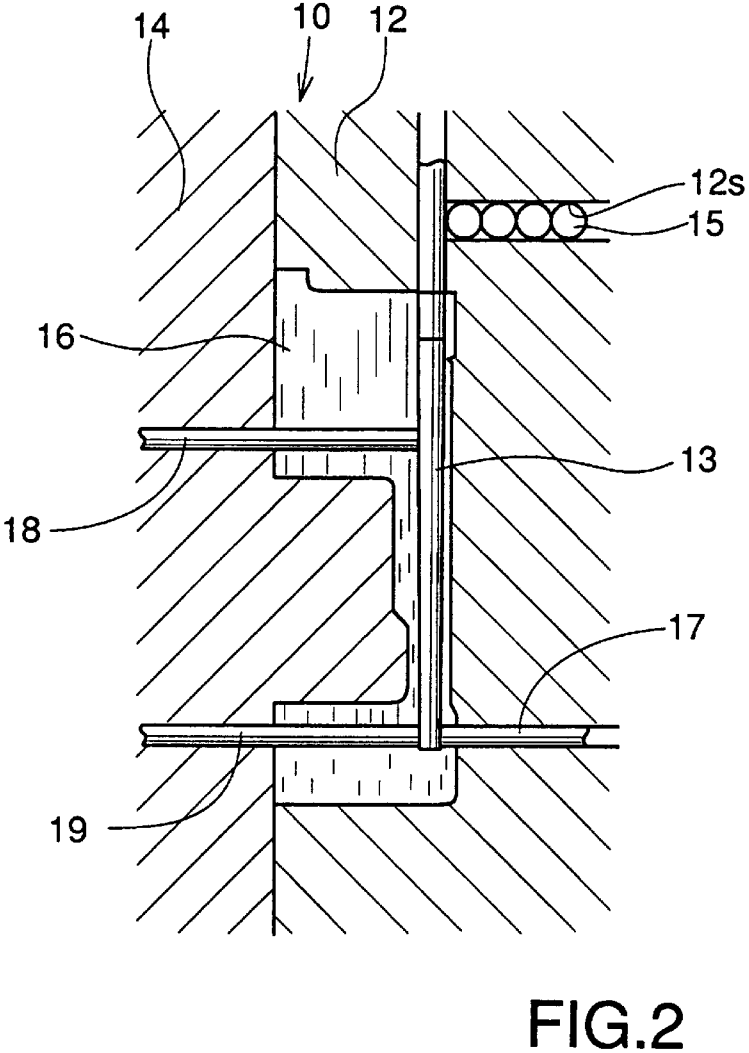
FIG. 2 is also a partial longitudinal sectional view of the casting machine of FIG. 1, showing the condition immediately after the cavity has been filled with the molten metal.
Figure 3:
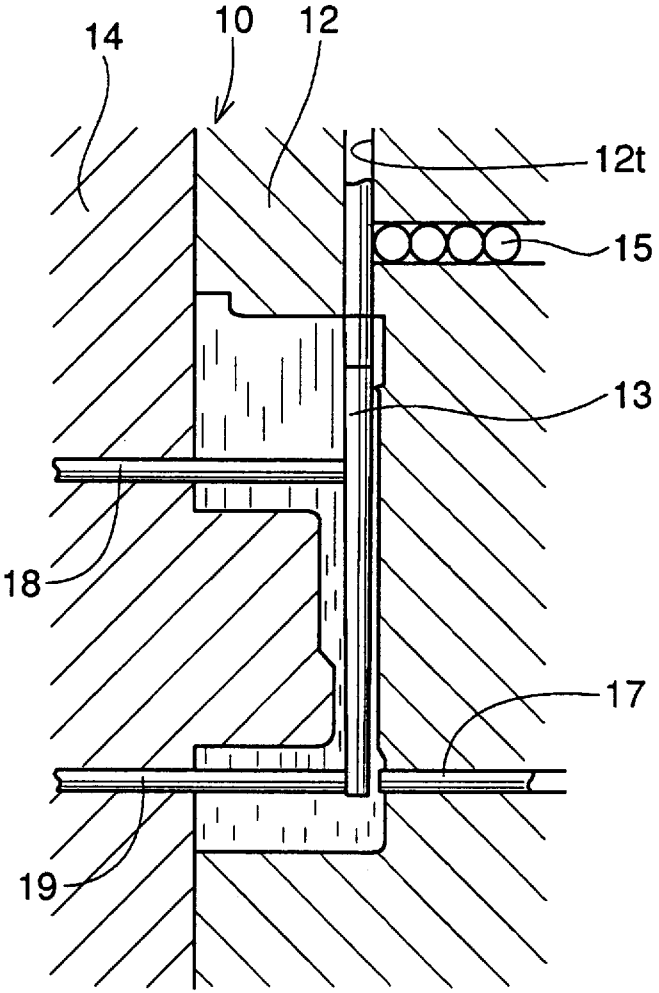
FIG. 3 is also a partial longitudinal sectional view of the casting machine of FIG. 1, showing the condition where a pressure pin has been drawn out.

Upon completion of the clamping of the molds 12 and 14, a predetermined amount of molten metal is supplied from an injection cylinder (not shown) into the cavity 16 at high speed, as shown in FIG. 2. While the molten metal is injected into the cavity 16, a lateral force is applied to the center slide pin 13 by the flow of the molten metal. When the cavity is filled with the molten metal, the center slide pin 13 is free from the lateral force. When the center slide pin 13 is free from the lateral force, a pressure pin 17 is retreated (see FIG. 3). Another predetermined amount of molten metal is supplemented between the center slide pin 13 and the retreated pressure pin 17, as shown in FIG. 3. The supplemented molten metal is supplied from outside the cavity 16. The pressure pin 17 is re-advanced to apply pressure to the molten metal solidifying in the cavity 16 so that blowholes are crushed and the structure of the casting W is rendered sound.

Figure 4:
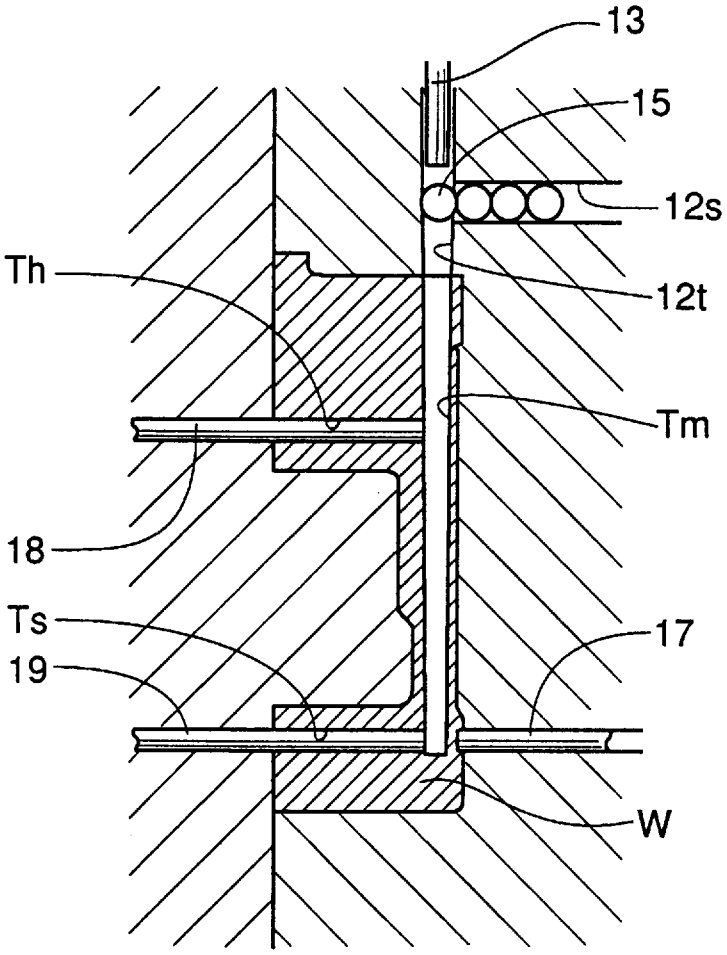
FIG. 4 is also a partial longitudinal sectional view of the casting machine of FIG. 1, showing the condition where the sliding member has been drawn out subsequently to solidification of the molten metal in the cavity.
Figure 5:
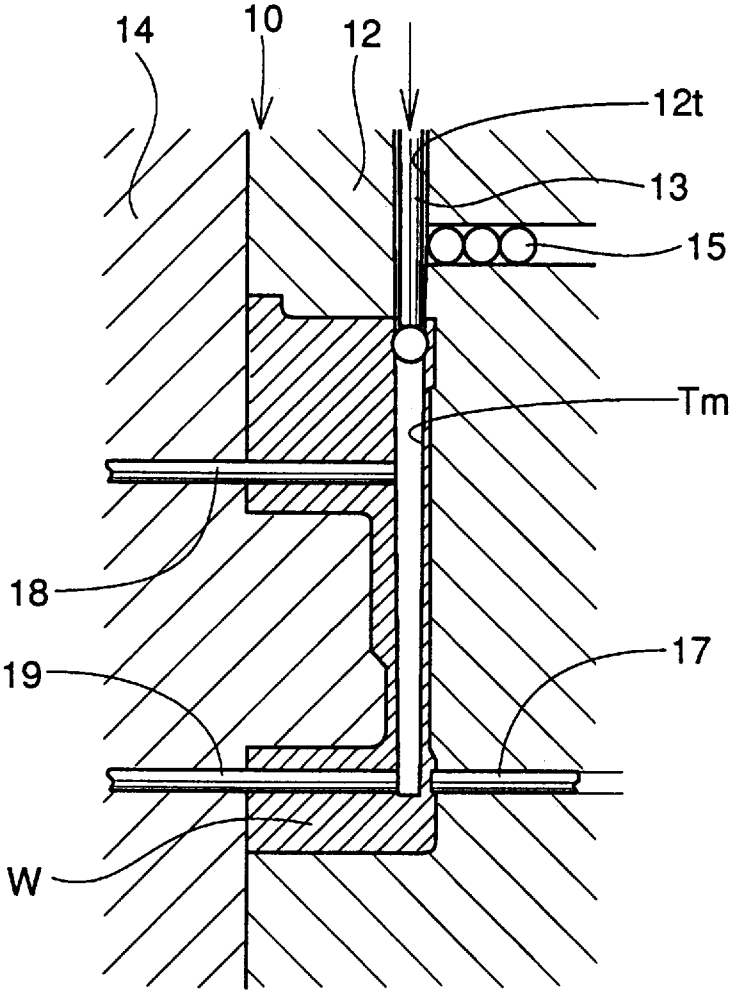
FIG. 5 is also a partial longitudinal sectional view of the casting machine of FIG. 1, showing the condition where a separate member has been force-fitted into the casting.

The center slide pin 13 is then moved upward to be thereby drawn out from the casting W when the molten metal in the cavity 16 is solidified with lapse of a predetermined time into such a degree as to maintain a certain shape. Consequently, the casting W is formed in the casting mold 9, as shown in FIG. 4. The main passage Tm is formed in the casting W.

The elevator mechanism is operated to move the center slide pin 13 upward so that its distal end is positioned higher than the ball passage 12*s*. More specifically, the ball passage 12*s* communicates with the pin guide passage 12*t* at a position between the distal end of the raised center slide pin 13 and the cavity 16. The first ball of the row of balls 15 in the ball passage 12*s* is pushed into the pin guide passage 12*t* when the distal end of the center slide pin 13 is moved upward to a position higher than the ball passage 12*s* (see FIG. 4).

The center slide pin 13 is lowered again from the above-described state so that the ball 15 supplied into the pin guide passage 12*t* is force-fitted into an upper end of the main passage Tm by the center slide pin 13. As a result, the end of the main passage Tm is closed by the ball 15. Thus, the separate member or the ball 15 is force-fitted into the concavity or the main passage Tm formed in the casting W while the casting W is enclosed in the casting mold 9.

Figure 6:
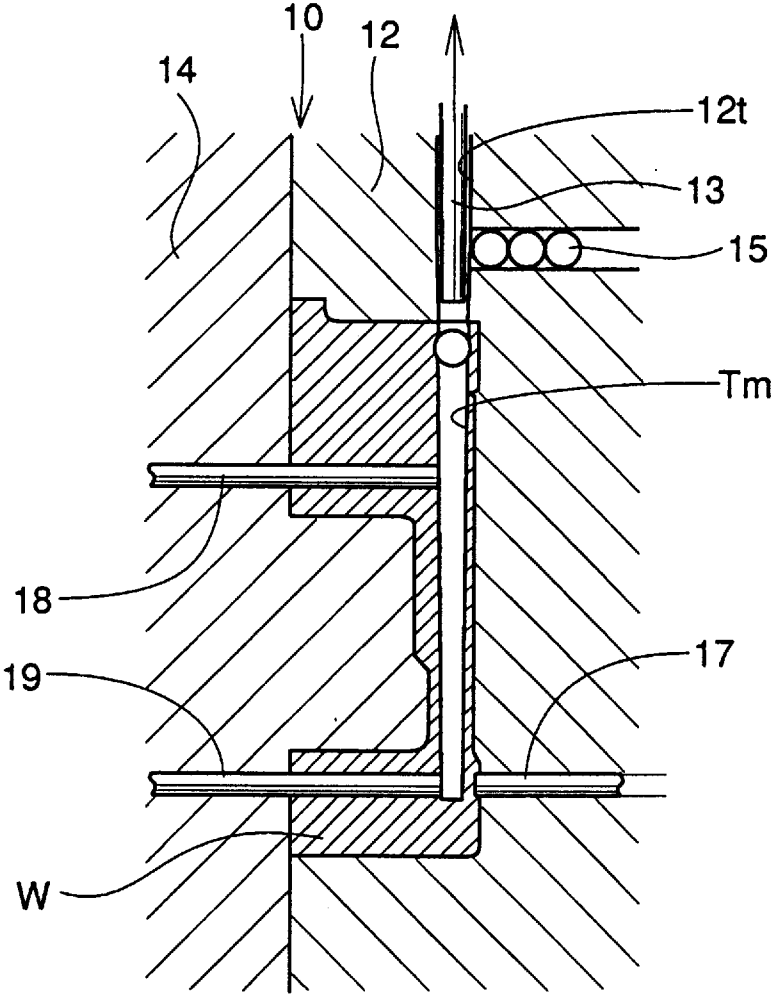
FIG. 6 is also a partial longitudinal sectional view of the casting machine of FIG. 1, showing the condition after the separate member has been force-fitted into the casting.

The center slide pin 13 is slightly moved upward to be drawn out from the casting W upon completion of the force-fitting of the ball 15 into the main passage Tm, as shown in FIG. 6. The distal end of the center slide pin 13 is held at a position lower than the ball passage 12*s* such that an exit of the ball passage 12*s* is closed by the side wall of the center slide pin 13. In this state, the molds 12 and 14 are opened.

In accordance with the above-described first embodiment, the separate member is force-fitted into the casting W while the latter is enclosed in the casting mold 9. While the casting W is enclosed in the casting mold, the metal of the casting is not so hard and the metal condition is suitable for press-fitting. Accordingly, the end of the passage need not be machined as conventionally executed, the manufacturing cost of the product can be reduced, and the manufacturing process and time can be shortened. Furthermore, the force-fitting of the separate member 15 is carried out before the casting W is taken out from the molds 12 and 14 or when the casting W is at a high temperature. Consequently, there arises no problem of crack, deformation, etc. of the casting W even when the force-fitting interference is set at a large value. Additionally, since the casting W has a larger shrinkage factor than the ball 5, the latter is securely fixed to the casting W when it is cooled.

Furthermore, since the center slide pin 13 of the casting machine is used to force-fit the ball 15 into the main passage Tm, no cylinder or pin dedicated to the force-fitting of the ball 15 is provided. Consequently, complication in the construction of the casting machine can be prevented and the equipment cost for the casting can be reduced. Alternatively, a sliding member dedicated to the force-fitting may be provided at the side opposite to the center slide pin 13 when a through hole is formed in the casting W by the center slide pin. In this case, too, the force-fitting can be executed while the casting is enclosed in the casting mold.

Second Embodiment

Figure 7:
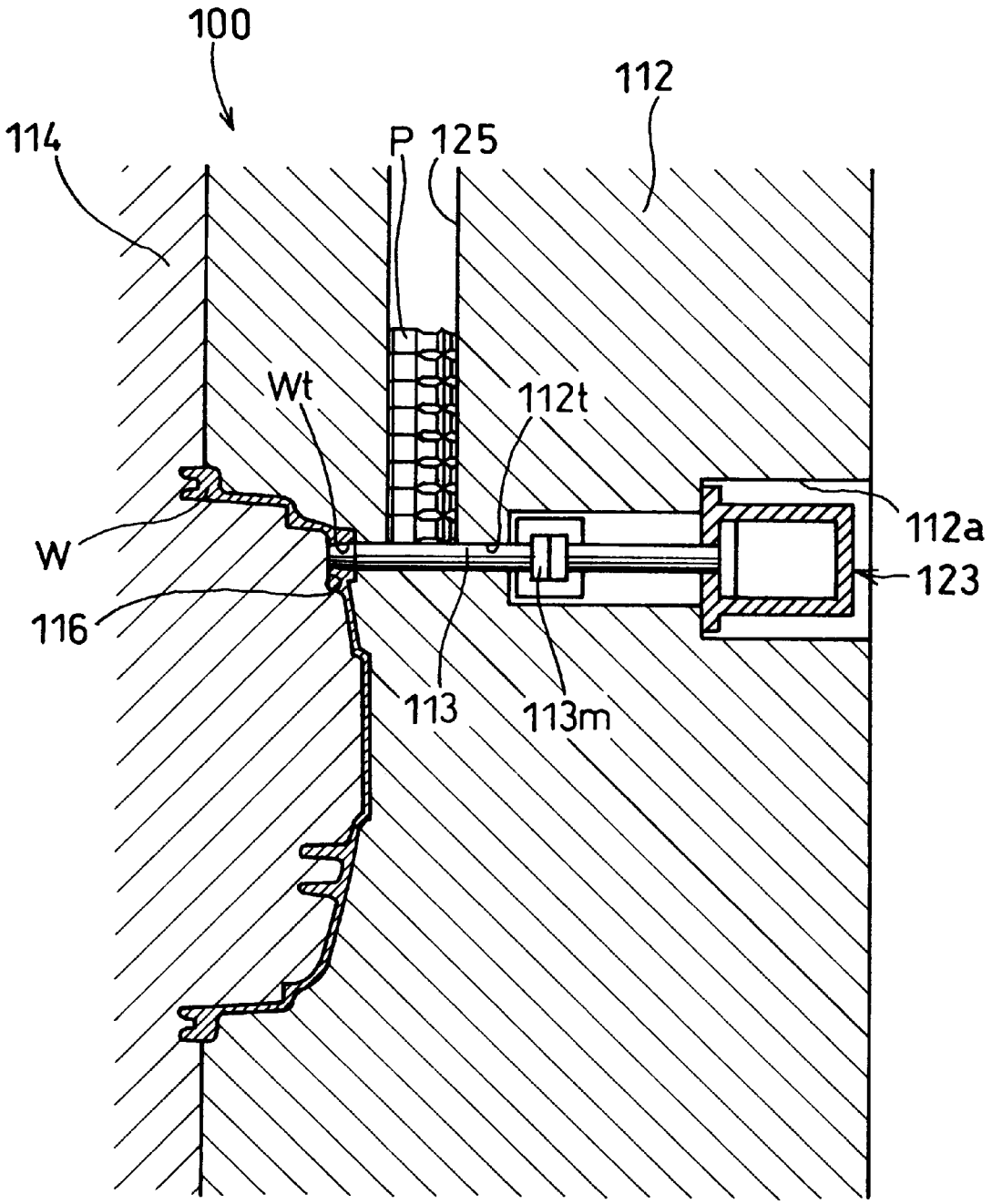
FIG. 7 is a partial longitudinal sectional view of the casting machine with a force-fitting mechanism according to a second embodiment of the invention.

A second embodiment of the invention will be described with reference to FIGS. 7 to 9(B). As shown in FIG. 7, a casting machine with a force-fitting mechanism of the second embodiment is equipped with a fixed metal mold 112 and a movable metal mold 114. The fixed and movable molds 112 and 114 are clamped by a mold clamping mechanism (not shown). In this state, a longitudinally elongated cavity 116 serving as a product molding space is defined in the interior of the casting mold.

The fixed mold 112 has a horizontally extending pin guide passage 112*t* formed therein to be continuous substantially perpendicularly to the upper interior of the cavity 116. The pin guide passage 112*t* is provided for guiding a slide pin 113 and has an inner diameter approximately equal to an outer diameter of the slide pin 113. The slide pin 113 is provided for forming in a casting W an opening Wt into which a pipe P is to be force-fitted and for force-fitting the pipe P into the opening Wt. The slide pin 113 is slidably accommodated in the pin guide passage 112*t* and connected at its proximal end 113*m* to a pushing cylinder 123.

The fixed mold 112 has a recess 112*a* formed in one side thereof. The pushing cylinder 123 is accommodated in the recess 112*a* to be positioned coaxial with the slide pin 113. The pushing cylinder 123 is operated for moving the slide pin 113 forward and backward along the pin guide passage 112*t*. FIG. 7 shows the condition where the slide pin 113 is in its forward end position.

A pipe passage 125 is continuous perpendicularly to a middle portion of the pin guide passage 112*t*. The pipe passage 125 is provided for accommodating a plurality of pipes P therein in parallel with the slide pin 113. The pipe passage 125 has a substantially equal transverse dimension to the length of each pipe P and a width substantially equal to the outer diameter of each pipe P. Accordingly, the pipes P are accommodated in the pipe passage 125 to be arranged in parallel to the slide pin 113. The outer diameter of each pipe P is set to be substantially equal to an outer diameter of the slide pin 113.

A coil spring (not shown) or the like is provided in the pipe passage 125 for urging the pipes P toward the pin passage 112*t*. Accordingly, one pipe P is automatically supplied to the pin guide passage 112*t* when the distal end of the slide pin 113 is moved backward behind the pipe passage 125. A cylinder, elastic member, etc. may be used instead of the coil spring. Furthermore, the self-weight of the pipes P may be utilized for urging them toward the pin guide passage 112*t*.

The operation of the casting machine of the second embodiment will be described. With the molds 112 and 114 being opened, the pushing cylinder 123 is driven so that the slide pin 113 is held at the forward end position. As a result, an exit of the pipe passage 125 is closed by the slide pin 113, and the pipes P are held in parallel with the slide pin 113 in the pipe passage 125. The mold clamping mechanism (not shown) is then operated to clamp the fixed and movable molds 112 and 114 together.

Figure 8:
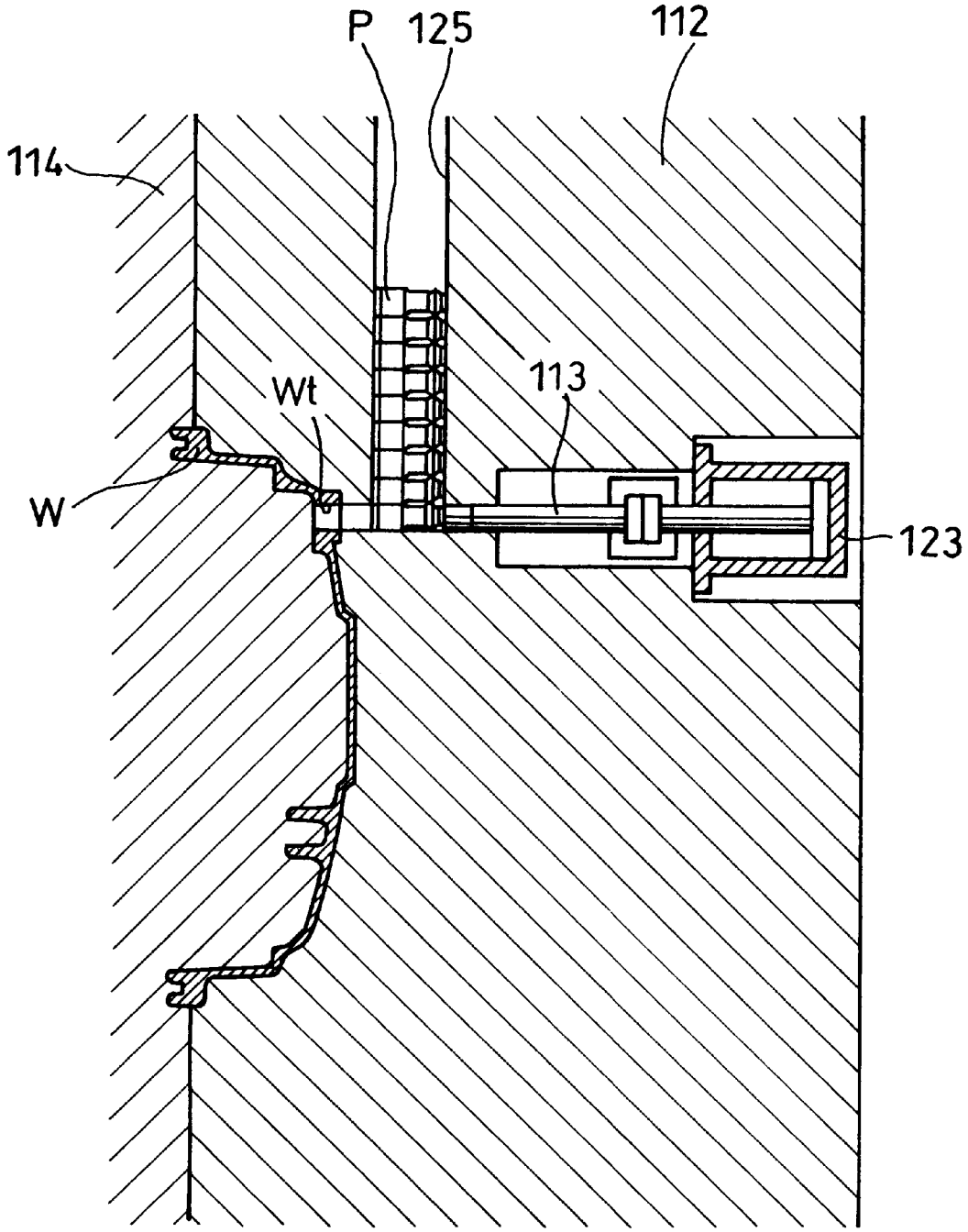
FIG. 8 is also a partial longitudinal sectional view of the casting machine of FIG. 7, showing the condition where the sliding member has been drawn out subsequently to solidification of the molten metal in the cavity.

Upon completion of the clamping of the molds 112 and 114, a predetermined amount of molten metal is supplied from an injection cylinder (not shown) into the cavity 116 at high speed, as shown in FIG. 7. When the molten metal in the cavity 116 is semi-solidified with lapse of a predetermined time or when the molten metal is solidified to such a degree as to maintain a certain shape, the pushing cylinder 123 is driven so that the slide pin 113 is pulled out from the semi-solidified molten metal, as shown in FIG. 8. Consequently, the opening Wt is formed in the semi-solidified molten metal which will hereinafter be referred to as "casting W" and the exit of the pipe passage 125 is opened so that one pipe P is supplied from the pipe passage 125 to the pin guide passage 112*t*.

Figure 9:
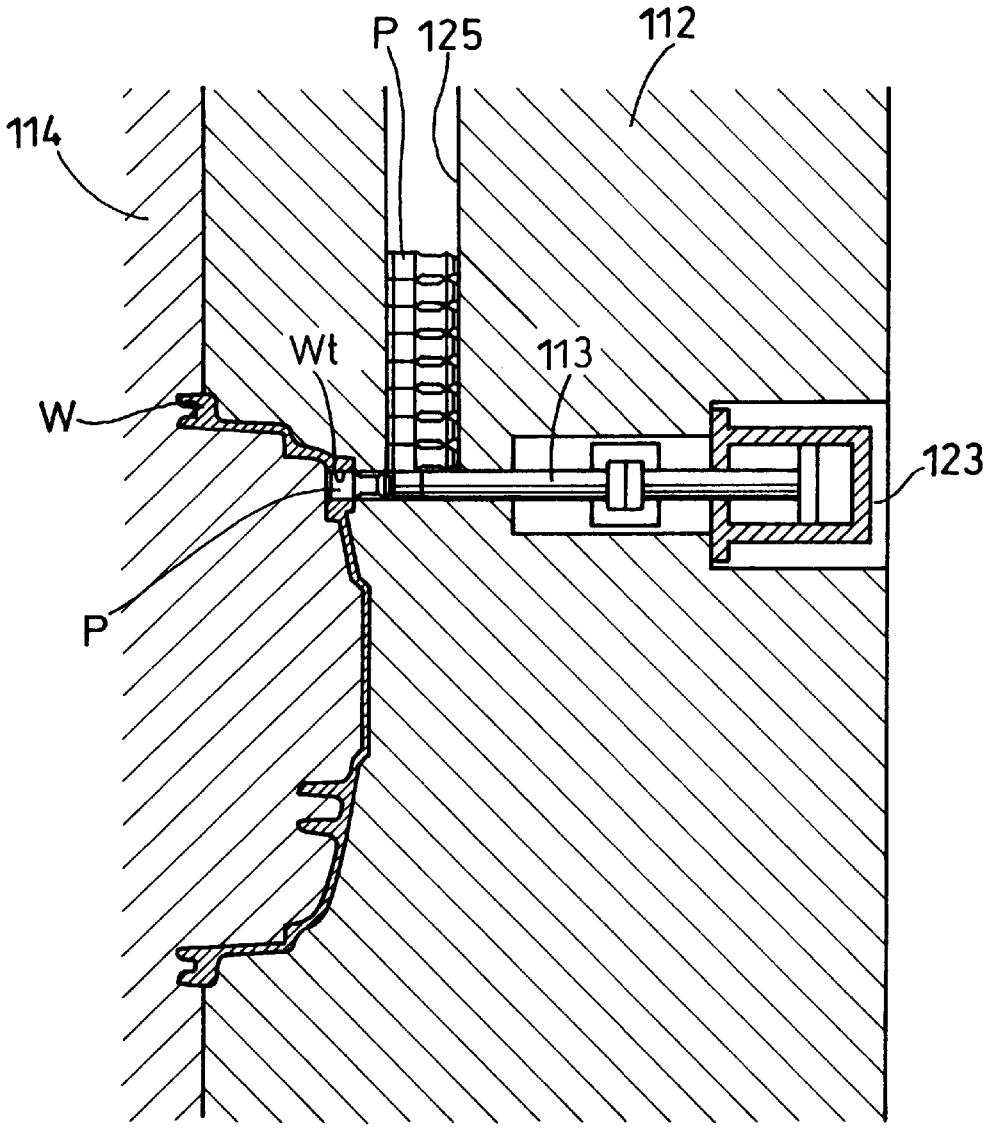
FIG. 9(A) is also a partial longitudinal sectional view of the casting machine of FIG. 7, showing the condition where the separate member has been force-fitted into the casting.
FIG. 9(B) illustrates in detail a pipe and an opening into which the pipe is to be force-fitted.
Figure 9:
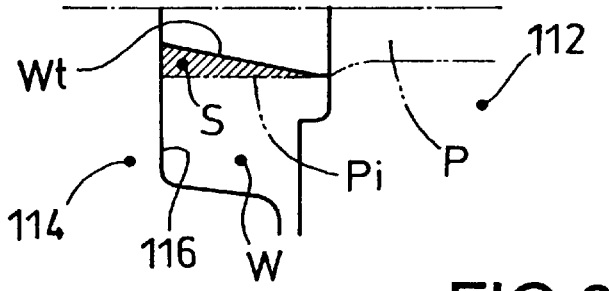

The pushing cylinder 123 is driven again to move the slide pin 113 forward. The pipe P supplied to the pin guide passage 112*t* is then pushed by the slide pin 113 axially to be thereby force-fitted into the opening Wt of the casting W, as shown in FIG. 9. The molten metal is completely solidified upon lapse of a predetermined time. The molds 112 and 114 are then opened and the casting W to which the pipe P is fixed is taken out from the molds. One cycle of the casting process is completed when the pushing cylinder 123 is driven to hold the slide pin 113 at the forward end position in preparation for the subsequent casting process.

In accordance with the above-described second embodiment, the pipe P is force-fitted into the opening Wt when the molten metal solidifies to such a degree as to maintain the certain shape in the cavity 116. The pipe P can be prevented from being subjected to the molten metal charging pressure and can be force-fitted into the casting W by a relatively smaller force. Consequently, the deformation of the pipe P or the like can be prevented. Furthermore, since the molten metal is prevented from entering the inside of the pipe P, the pipe can reliably be fixed to the casting W only if the pipe has a thickness sufficient for the force-fitting.

Furthermore, a force-fitted portion Pi of the pipe P is cylindrical, whereas the slide pin 113 is provided with a draft on its distal end. Consequently, the opening Wt formed by the slide pin 113 has a diameter smaller by a shaded portion S than the force-fitted portion Pi of the pipe P, as shown in FIG. 9(B). When the pipe P is force-fitted into the opening Wt with the molten metal in the semi-solidified state, a radial pressure is applied to the shaded portion S by the pipe P such that the shaded portion S is squeezed. Consequently, the structure of the casting W is densified, and the degree of adhesion between the pipe P and the casting W can be improved. Furthermore, the degree of adhesion can further be improved by shrinkage due to solidification of the molten metal. Furthermore, the accuracy in machining the pipes P may be lower as compared with the prior art in which a pipe is force-fitted into a machined opening. Additionally, since the pipe P is force-fitted into the opening Wt before the molds 112 and 114 are opened, the casting W is peripherally backed up by the molds 112 and 114 during the force-fitting step. Consequently, occurrence of cracks in the casting due to the force-fitting can be restricted.

Third Embodiment

Figure 10:
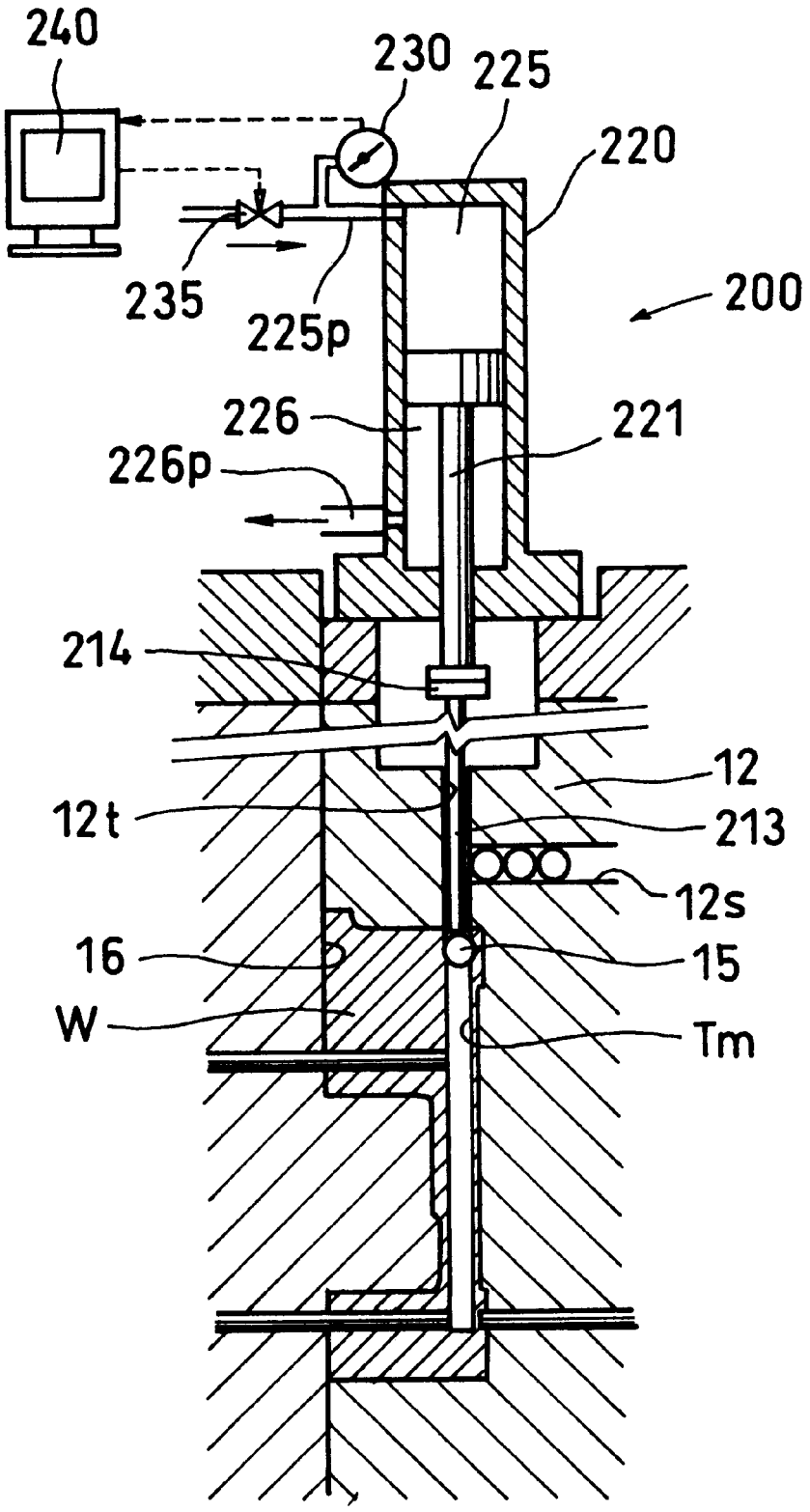
FIG. 10 is a partial longitudinal sectional view of the casting machine with a force-fitting mechanism according to a third embodiment of the invention.
Figure 11:
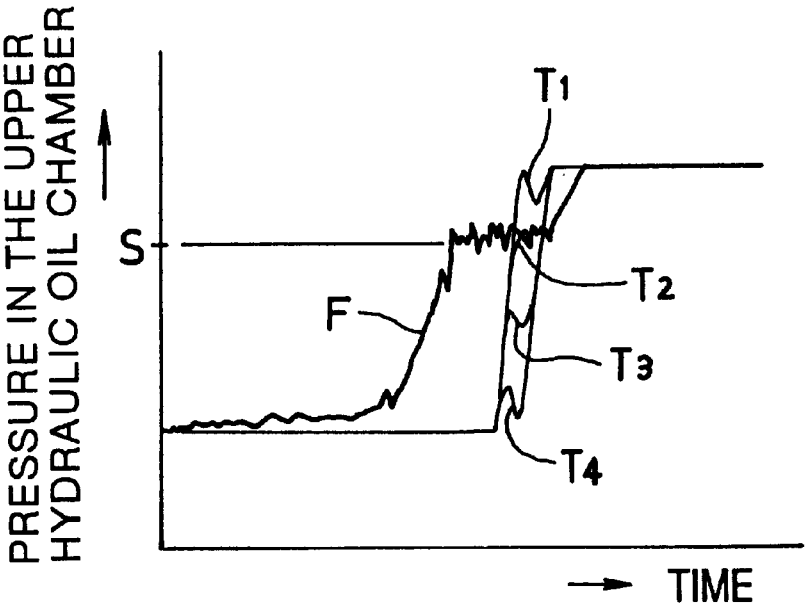
FIGS. 11(A) and 11(B) are graphs of the changes in the force required for the force-fitting by the casting machine of FIG. 7.
Figure 11:
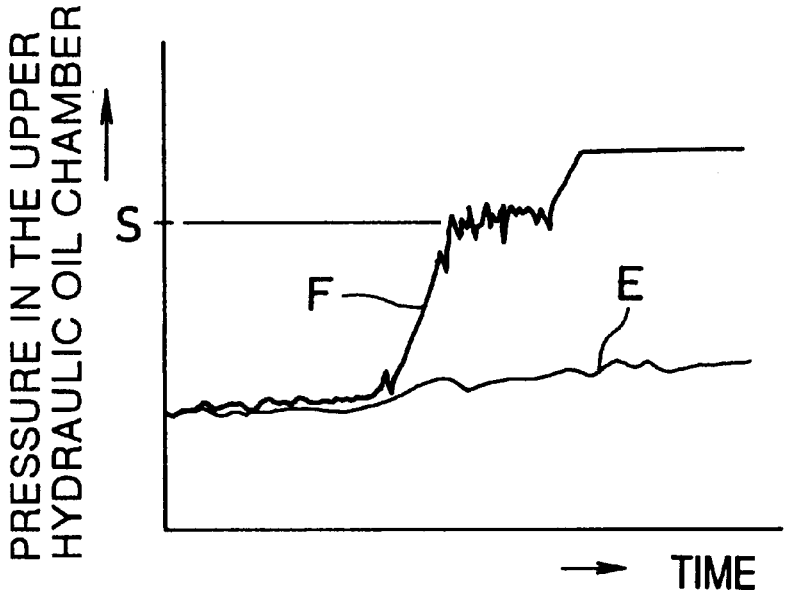

FIGS. 10 and 11 illustrate a third embodiment of the invention. As shown in FIG. 10, a casting machine 200 of the third embodiment incorporates an improvement in the elevator mechanism for the center slide pin 13 of the casting machine 10 in the above-described first embodiment. The other construction of the casting machine 200 of the third embodiment is the same as that in the first embodiment. Accordingly, the identical parts are labeled by the same reference symbols in the third embodiment as in the first embodiment and the description of them will be eliminated.

A center slide pin 213 of the casting machine 200 is connected at its proximal end to a piston rod 221 of a lift cylinder 220. The lift cylinder 220 is mounted to the top of the fixed mold 12 to be coaxial with the center slide pin 213. The lift cylinder 220 is operated to move the center slide pin 213 upward and downward along the pin guide passage 12*t*. The lift cylinder 220 has upper and lower hydraulic oil chambers 225 and 226. First and second hydraulic oil pipes 225*p* and 226*p* are connected to the upper and lower hydraulic oil chambers 225 and 226 respectively. Hydraulic oil is supplied through the first hydraulic oil pipe 225*p* to the upper hydraulic oil chamber 225 so that the center slide pin 213 is lowered. The hydraulic oil is supplied through the second hydraulic oil pipe 226*p* to the lower hydraulic oil chamber 226 so that the center slide pin 213 is moved upward.

The first hydraulic oil pipe 225*p* is provided with a pressure sensor 230 for detecting pressure in the upper hydraulic oil chamber 225 and a flow rate control valve 235 for controlling the amount of the hydraulic oil supplied to the upper hydraulic oil chamber 225 per a unit time. The pressure sensor 230 detects the pressure in the upper hydraulic oil chamber 225, thereby generating a pressure signal representative of the pressure in the upper hydraulic oil chamber 225. The pressure signals are continuously inputted to a computer 240, which delivers a control signal so that the control valve 235 is remote controlled on the basis of the control signal.

The operation of the casting machine will be described. Upon solidification of the molten metal, the hydraulic oil is supplied to the lower hydraulic oil chamber 226 of the lift cylinder 220 so that the center slide pin 213 is moved upward to be thereby pulled out from the casting W. As a result, a longitudinal main passage Tm is formed in the casting W. Furthermore, one of the balls 15 in the ball passage 12*s* is supplied into the pin guide passage 12*t*. The hydraulic oil is then supplied to the upper hydraulic oil chamber 225 of the lift cylinder 220 so that the center slide pin 213 is lowered. The ball 15 in the pin guide passage 12*t* is pushed by the center slide pin 213 into the main passage Tm, whereupon the force-fitting is initiated.

When the pressure in the upper hydraulic oil chamber 225 detected by the pressure sensor 230 is at or above a predetermined value S, the control valve 235 is opened to a predetermined extent of opening so that the ball 15 is force-fitted into the main passage Tm at a predetermined speed. On the other hand, the control valve 235 is throttled to reduce an amount of oil supplied to the upper hydraulic oil chamber 225 when the detected pressure in the upper hydraulic oil chamber 225 is below the predetermined value S, that is, when a force required for the force-fitting of the ball 15 into the main passage Tm is small. Consequently, a lowering speed of the center slide pin 213 is reduced such that the force-fitting of the ball 15 is performed extremely slowly.

The solidification of the casting W is incomplete when the force required for the force-fitting is small. In this case, the speed of the force-fitting is reduced and the solidification of the casting progresses. As the solidification progresses, the force required for the force-fitting is increased. When the force required for the force-fitting is increased to or above the predetermined value S with the progress of solidification of the casting W, the control valve 235 is opened to the predetermined extent of opening so that the ball 15 is force-fitted into the main passage Tm at the predetermined speed.

Graph F in each of FIGS. 11(A) and 11(B) represents an oil pressure (force-fitting pressure) in the upper hydraulic oil chamber 225 when the force-fitting is executed in accordance with the above-described method. Graphs T1, T2, T3 and T4 of FIG. 11(A) represent force-fitting pressures when the force-fitting timing is uniformly set by a timer. The force-fitting pressure varies among the graphs T1–T4. The variations in the force-fitting pressure are considered to result from the differences in the progress of solidification of the molten metal under the influence of the temperatures of the metal molds 12 and 14 and/or the molten metal. Thus, a stable fitting force cannot be obtained from a manner in which the force-fitting timing is uniformly set by a timer.

According to the third embodiment, however, the center slide pin 213 is slowly operated when the force-fitting pressure is small. The force-fitting is executed at the predetermined speed when the force-fitting pressure (force-fitting reactive force) has been increased to the predetermined value S. Consequently, since an amount of hydraulic oil supplied to the upper hydraulic chamber 225 is varied on the basis of the signals from the pressure sensor 230, the force-fitting can stably be executed with an optimum fitting force being applied to the ball 15 even when the progress of solidification of the molten metal differs under the influence of the temperatures of the metal molds 12 and 14 and/or the molten metal.

Graph E of FIG. 11(B) shows the changes in the force-fitting pressure when the ball 15 has not been supplied from the ball passage 12*s* to the pin guide passage 12*t*. In this case, the force-fitting pressure (force-fitting reactive force) is not increased to the predetermined value S and accordingly, the center slide pin 213 is slowly operated. This results in a prompt determination of abnormal force-fitting. Furthermore, the determination of abnormal force-fitting can readily be made when a pressure waveform in the force-fitting is compared with the one in a normal force-fitting.

Fourth Embodiment

Figure 12:
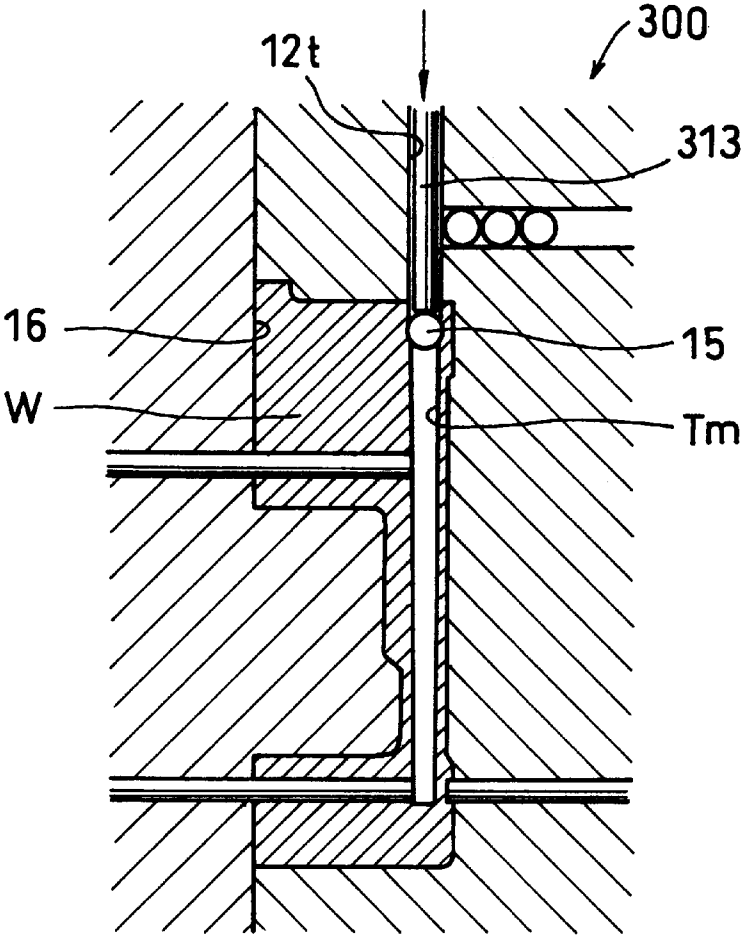
FIG. 12 is a partial longitudinal sectional view of a casting machine with a force-fitting mechanism according to a fourth embodiment of the invention.

FIGS. 12 to 14(B) illustrate a fourth embodiment of the invention. As shown in FIG. 12, a casting machine 300 of the fourth embodiment incorporates an improvement in the configuration of the distal end of the center slide pin 13 of the casting machine 10 in the above-described first embodiment. The other construction of the casting machine 300 is the same as that in the first embodiment. Accordingly, the identical parts are labeled by the same reference symbols in the fourth embodiment as in the first embodiment and the description of them will be eliminated.

Figure 13:
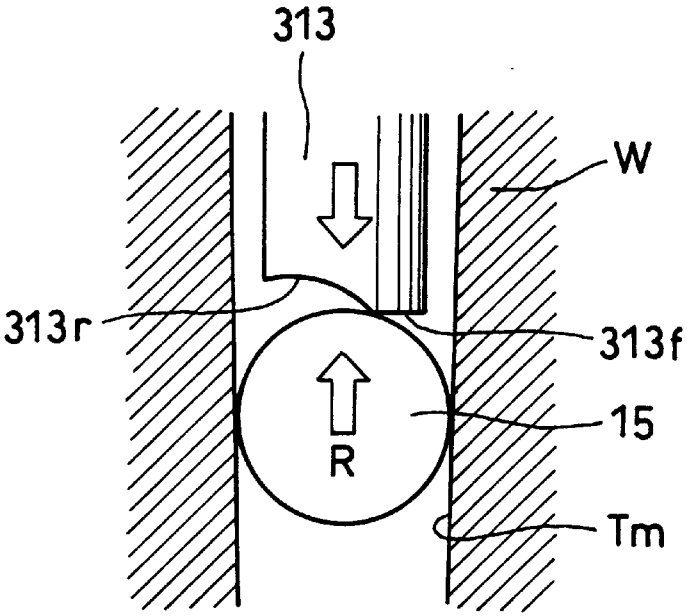
FIG. 13 illustrates a distal end of a sliding member and a separate member of the casting machine of FIG. 12.
Figure 14:
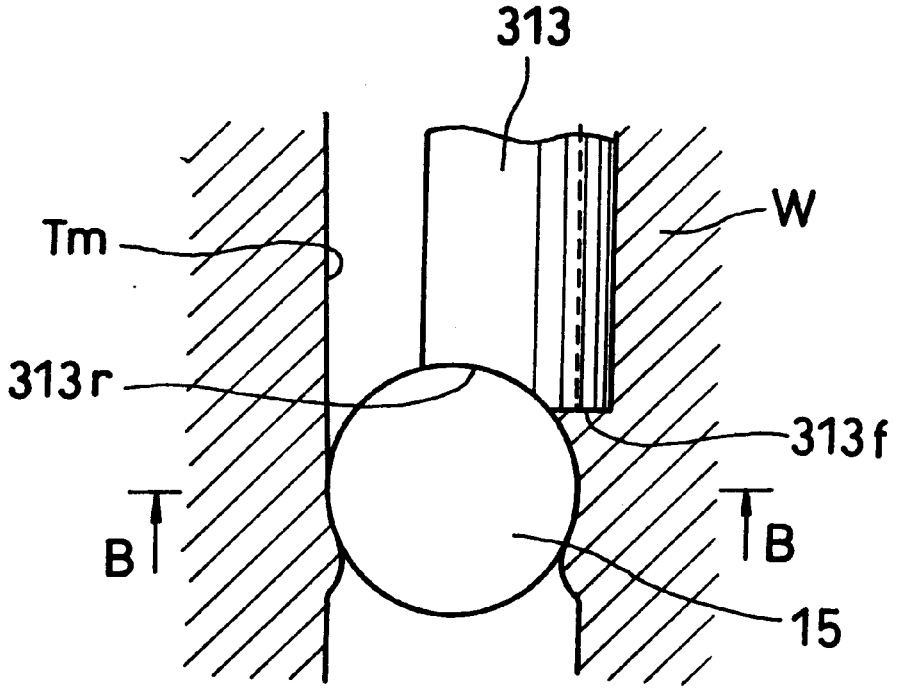
FIG. 14(A) is a side view of the separate member and the sliding member of the casting machine of FIG. 12 during the force-fitting step.
FIG. 14(B) is a plan view of the separate member and the sliding member of the casting machine of FIG. 12 during the force-fitting step.
Figure 14:
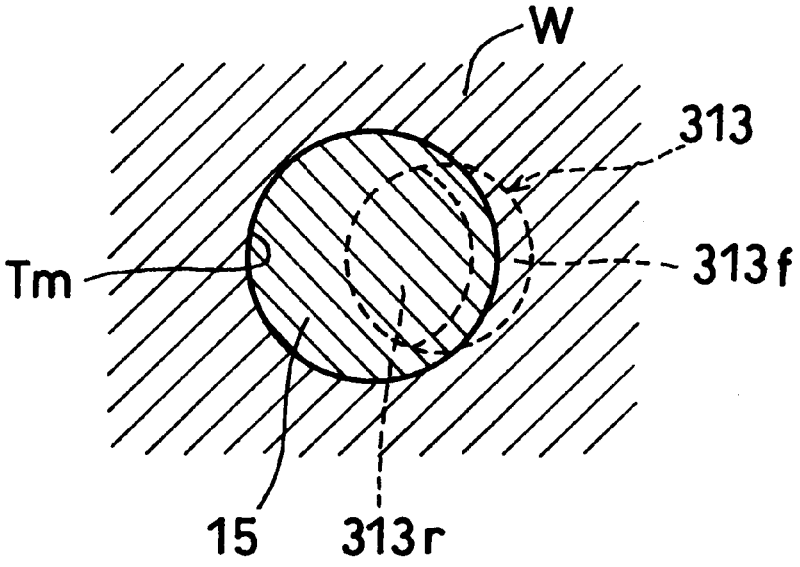

The center slide pin 313 of the casting machine 300 has in its distal end a spherical depression 313*r* eccentric to the axis thereof, as shown in FIG. 13. The spherical depression 313*r* has a radius of curvature slightly larger than the radius of the ball 15 serving as the separate member to be force-fitted.

The center slide pin 313 is lowered to force-fit the ball 15 into the casting W. The ball 15 is pushed by a boundary between the spherical depression 313*r* and a distal end surface 313*f* of the center slide pin 313, as shown in FIG. 13, until the ball 15 is guided into the main passage Tm of the casting W. However, after having come into contact with the inner wall surface of the main passage Tm, the ball 15 is advanced inward, elastically deforming the inner wall surface of the main passage Tm. This movement of the ball 15 results in a reactive force R, which axially acts at a position offset from the axis of the center slide pin 313.

Upon occurrence of the reactive force R, the center slide pin 313 is elastically deformed by the reactive force R and the pushing force F thereof in its bending direction, whereupon the spherical depression 313*r* is located on the surface of the ball 15, as shown in FIGS. 14(A) and 14(B). More specifically, the center slide pin 313 is displaced such that the axis thereof is deviated from the center of the ball 15. As a result, a part of the distal end surface 313*f* of the pin 313 is forced out to the inner wall surface side of the main passage Tm. The center slide pin 313 is further lowered under this condition such that the ball 15 is pushed by the spherical depression 313*r* thereof and the inner wall surface of the main passage Tm is deformed by the forced-out part of the center slide pin 313. Consequently, the inner wall surface of the main passage Tm is plastically deformed to be inwardly protuberant, and the ball 15 is force-fitted into the main passage Tm and simultaneously caulked, as shown in FIGS. 14(A) and 14(B). Since the eccentricity of the center slide pin 313 relative to the ball 15 results from the elastic deformation of the former, there is no problem for a continuous use of the center slide pin 313.

According to the fourth embodiment, the ball 15 is force-fitted into the main passage Tm with the inner wall of the passage being deformed by the center slide pin 313. The ball 15 is caulked by the deformation of the main passage Tm. Consequently, the ball 15 can reliably fixed in the main passage Tm of the casting W.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

What is claimed is:

1. A method of force-fitting a separate member into a casting, comprising the steps of:

filling a cavity defined by a casting mold with a molten metal in such a condition that a sliding member movable forward and rearward has been moved into the cavity;

drawing out the sliding member from the cavity when the molten metal is solidified to such a degree as to maintain a certain shape; and force-fitting the separate member into a passage formed in the casting by means of the sliding member before the casting mold is opened.

2. A method according to claim 1, wherein the separate member is a ball and closes the passage when force-fitted thereinto.

3. A method according to claim 1, wherein the separate member is a pipe and communicates with the passage when force-fitted thereinto.

4. A method according to claim 1, wherein the force-fitting step includes the additional step of detecting a magnitude of a force required for the force-fitting so that a force-fitting speed is reduced when the detected magnitude is below a predetermined value and so that the force-fitting speed is set at a predetermined one when the detected magnitude is at or above the predetermined value.

5. A method according to claim 1, wherein an end of the passage in which the separate member has been force-fitted is caulked during the force-fitting step.

6. A method of force-fitting a separate member into a casting, comprising the steps of:

filling a cavity defined by a casting mold with a molten metal in such a condition that a sliding member movable forward and rearward has been moved into the cavity;

drawing out the sliding member from the cavity when the molten metal is solidified to such a degree as to maintain a certain shape;

placing the separate member between a distal end of the sliding member drawn out and the cavity; and moving the sliding member forward so that the separate member is force-fitted into a passage formed in the casting by the sliding member before the casting mold is opened.

7. A method according to claim 6, wherein the separate member is a ball and closes the passage when force-fitted thereinto.

8. A method according to claim 6, wherein the separate member is a pipe and communicates with the passage when force-fitted hereinto.

9. A method according to claim 6, wherein the force-fitting step includes the additional step of detecting a magnitude of a force required for moving the sliding member forward so that a force-fitting speed is reduced when the detected magnitude is below a predetermined value and so that the force-fitting speed is set at a predetermined one when the detected magnitude is at or above the predetermined value.

10. A method according to claim 6, wherein the distal end of the sliding member deforms a wall defining the passage in the force-fitting step.

11. An apparatus for force-fitting a separate member into a casting product, comprising:

a mold having a cavity defining the casting product and a passage into the cavity;

a sliding member movable between a position at which the same has been moved into the cavity, thereby closing the passage, and a second position at which the same has been withdrawn from the cavity, wherein said sliding member has such a configuration as to abut against the separate member at a position displaced from an axis thereof and is subjected to an axial force at the displaced position, thereby flexing in a direction substantially perpendicular to the axis; and means for supplying the separate member into a location between the passage in the cavity and a distal end of the sliding member at the second position; and means for inserting the separate member and the sliding member into the casting product after the larter has been withdrawn from the cavity.

12. An apparatus according to claim 11, wherein the supplying means has a passage along which the separate member passes and which communicates with the guide passage at a location between the cavity and the distal end of the sliding member at the second position.

13. An apparatus according to claim 11, wherein the re-advancing means includes a detector for detecting a force required for advancing the sliding member and speed adjusting means for reducing a force-fitting speed when the detected force is below a predetermined value and setting the force-fitting speed at a predetermined one when the detected force is at or above the predetermined value.

14. A method of manufacturing a cast product having a passage therein, comprising the steps of:

inserting a slidable member into a cavity within a mold, the cavity defining the cast product:

filling the cavity with molten metal;

withdrawing the slidable member to create the passage within the cast product; and using a sliding member for force fitting a member inside the passage before the casting mold is opened.

15. A method as claimed in claim 14 further comprising the step of opening the mold after force-fitting the member inside the passage.

16. A method as claimed in claim 14 wherein force-fitting the member inside the passage comprises the steps of:

detecting a magnitude of force required to force fit the member;

selecting a predetermined force-fitting speed to insert the member into the passage when the detected magnitude is at or above a predetermined value; and selecting a reduced force-fitting speed when the detected magnitude is below a predetermined value.

17. A method as claimed in claim 14, further comprising the step of caulking an end of the passage during the force-fitting step.

18. An apparatus, comprising:

a mold having a cavity defining a cast product, a first means for defining a passage within the cast product when the cavity is filled with molten metal;

a second means for inserting the first means into the cavity and withdrawing the first means from tile cast product; and a third means for force-fitting a member inside the passage defined within the cast product, the third means being configured to abut the member at a position displaced from an axis thereof and being subjected to an axial force at the displaced position, whereby the third means flexes in a direction substantially perpendicular to the axis.

19. An apparatus as in claim 18, wherein the first means and the third means are a pin.

20. An apparatus as in claim 18, further comprising means for supplying the member to a position between the third means and the passage.

21. An apparatus as in claim 18 further comprising:

a means for detecting a force required to force-fit the member into the passage; and a means for adjusting a force fitting speed when the detected force is below a predetermined value.

22. An apparatus as in claim 18 wherein the mold further comprises an opening to the cavity and the first means has a cross-section that is approximately identical to the opening.

* * * * *